US005440782A

United States Patent [19]

Yamashita

[11] Patent Number: 5,440,782

[45] Date of Patent: Aug. 15, 1995

[54] SUCTION NOZZLE ATTACHMENT FOR VACUUM CLEANER

[75] Inventor: Shusuke Yamashita, Hamamatsu, Japan

[73] Assignee: Azuma Industrial Co., Ltd., Hamamatsu, Japan

[21] Appl. No.: 158,273

[22] Filed: Nov. 29, 1993

[30] Foreign Application Priority Data

Dec. 28, 1992 [JP] Japan ..... 4-093727 U

[51] Int. Cl.[6] ..... A47L 9/06

[52] U.S. Cl. ..... 15/398; 15/381; 15/420

[58] Field of Search ..... 15/398, 399, 400, 420, 15/421

[56] References Cited

U.S. PATENT DOCUMENTS

| | | | |
|---|---|---|---|
| 1,971,493 | 8/1934 | Leathers | 15/399 X |
| 2,941,233 | 6/1960 | Prong | 15/398 |
| 3,358,317 | 12/1967 | Woodruff | 15/398 |
| 3,550,183 | 12/1970 | Wolf | 15/420 X |
| 4,091,496 | 5/1978 | Desrosiers et al. . | |
| 4,198,727 | 4/1980 | Farmer | 15/398 X |
| 4,475,265 | 10/1984 | Berfield . | |
| 4,653,137 | 3/1987 | Fleischhauer . | |
| 5,063,635 | 11/1991 | Ishii et al. | 15/420 X |
| 5,123,141 | 6/1992 | Erickson et al. . | |

FOREIGN PATENT DOCUMENTS

| | | | |
|---|---|---|---|
| 504656 | 7/1951 | Belgium | 15/398 |
| 0264625 | 4/1988 | European Pat. Off. . | |
| 690645 | 4/1953 | United Kingdom . | |

*Primary Examiner*—Christopher K. Moore

*Attorney, Agent, or Firm*—Oblon, Spivak, McClelland, Maier, Neustadt

[57] ABSTRACT

A vacuum cleaner suction nozzle attachment which permits to use a vacuum cleaner in the fashion of a broom, namely, which is capable of vacuuming dust while sweeping dust out of a narrow space or out of a corner portion of a wooden or Tatami floor. The suction nozzle attachment includes a joint pipe 1 which is connectible to a suction pipe of a vacuum cleaner. The joint pipe 1 has its fore end pivotally connected to an apex portion of a brush holder box 2 of a flattened box-like shape for adjustments of the joint pipe angle relative to the brush holder box. A brush is mounted in an intake opening at the bottom of the brush holder box so that the suction nozzle attachment presents a broom-like shape as a whole.

12 Claims, 4 Drawing Sheets

SUCTION NOZZLE ATTACHMENT FOR VACUUM CLEANER

<FIELD OF THE INVENTION>

This invention relates to a suction nozzle attachment for vacuum cleaners the suction nozzle attachment being connectible to the fore end of a vacuum cleaner suction pipe for the purpose of adding a broom-like touch to the vacuuming operation.

<BACKGROUND 0F THE INVENTION>

The conventional vacuum cleaners are generally equipped with a nozzle attachment in the form of a suction box 21 of a rectangular box-like shape as shown in FIGS. 7 and 8, the suction box 21 having a brush 22, for example, along the front and rear sides of an intake opening 23 which opens on the bottom side of the suction box 21 and which is in communication with a suction pipe 24 of the cleaner. The just-mentioned suction pipe 24 is connected to the suction box 21 on the upper side of and at right angles with the longitudinal direction of the latter, so that the suction box 21 can be moved back and forth together with the suction pipe 24 in a vacuuming operation in a direction perpendicular to the length of the suction box 21.

Ordinary vacuum cleaners of this sort, which are originally designed to suck in dust on carpeted floors or the like, are usually provided with various additional measures for adapting themselves to wooden floors or Tatami floors. However, it is often the case that such additional measures are still found unsuitable for vacuuming wooden or Tatami floors of relatively small houses although they suit vacuuming operations on relatively broad carpeted floors or the like.

On the other hand, the brooms which have been conventionally used for cleaning floor surfaces are no more than a tool for sweeping and gathering dust on a floor surface and therefore cannot be as conveniently used for cleaning a broad floor surface as vacuum cleaners which can remove dust by sucking action. However, especially in case of the so-called Japanese style houses with small rooms, the broom is very conveniently used for sweeping and cleaning up dust in narrow spaces or in corner portions by changing the direction of the tip end of the broom.

Therefore, it is desirable for a vacuum cleaner to have additionally the broom-like handiness so that it can be used very conveniently on both broad and narrow floor surfaces even by those people who are accustomed to brooms only.

<SUMMARY OF THE INVENTION>

It is an object of the present invention to provide a suction nozzle attachment for vacuum cleaners, which can add a broom-like handiness to a vacuum cleaner so that the operator can sweep dust out of a narrow space or a narrow corner portion especially in a relatively small house with a wooden or Tatami floor.

In accordance with the present invention, the above-stated objective is achieved by the provision of a suction nozzle attachment for a vacuum cleaner, which includes: a joint pipe and a brush retainer box of a flattened box-like shape having an intake opening on the bottom side thereof, the Joint pipe being connectible to a suction pipe of the vacuum cleaner and having the fore end thereof connected to an apex portion of the brush holder box, and the brush holder box having a brush mounted in the intake opening on the bottom side thereof in such a manner as to present a broom-like shape as a whole when the suction nozzle attachment is connected to the suction pipe of the vacuum cleaner.

In a preferred form of the invention, the joint pipe is pivotally connected to the brush holder box to permit adjustments of the joint pipe angle relative to the brush holder box in a plane between flattened side surfaces of the latter.

Preferably, the above-mentioned brush is located centrally of the intake opening on the bottom side of the brush holder box in such a manner as to bisect the intake opening into a couple of segmental intake openings.

Further, the intake opening on the bottom side of the brush holder box may be slightly extended upward at the opposite ends of the brush holder box, and the opposite end portions of the brush may be turned upward into the extended end portions of the intake opening, thereby to provide additional intake openings or gaps at the opposite ends of the brush holder box.

In a still another form of the invention, the brush is rockably mounted in the take opening at the bottom of the brush holder box and adapted to be tilted toward side walls of the brush holder box as the suction nozzle attachment is moved in sideward directions, alternately closing and opening the segmental intake openings on the opposite sides of the brush.

<PARTICULAR DESCRIPTION OF THE INVENTION>

Referring to FIGS. 1 through 4, there is illustrated a vacuum cleaner suction nozzle attachment embodying the present invention. This suction nozzle attachment includes a joint pipe 1 for connection to the suction pipe of a vacuum cleaner, the joint pipe 1 being swingably or pivotally connected to an apex portion of a brush holder box 2. The brush holder box 2 is in the form of a box with flattened side walls of substantially triangular shape and has a brush 3, which will be described later, mounted in an intake opening which is opened on the bottom side thereof. Although not illustrated, the brush holder box 2 is provided with an opening also in its apex portion, and the angularly adjustable joint pipe 1 is connected to the brush holder box 2 in such a manner as to close the apex opening.

Therefore, when the joint pipe 1 is connected to the suction pipe of the vacuum leaner, the suction nozzle attachment and the suction pipe present together the shape of a broom as a whole, the suction pipe serving as a broomstick in addition to the function as a passage for dust-entraining suction air.

Figure 1:
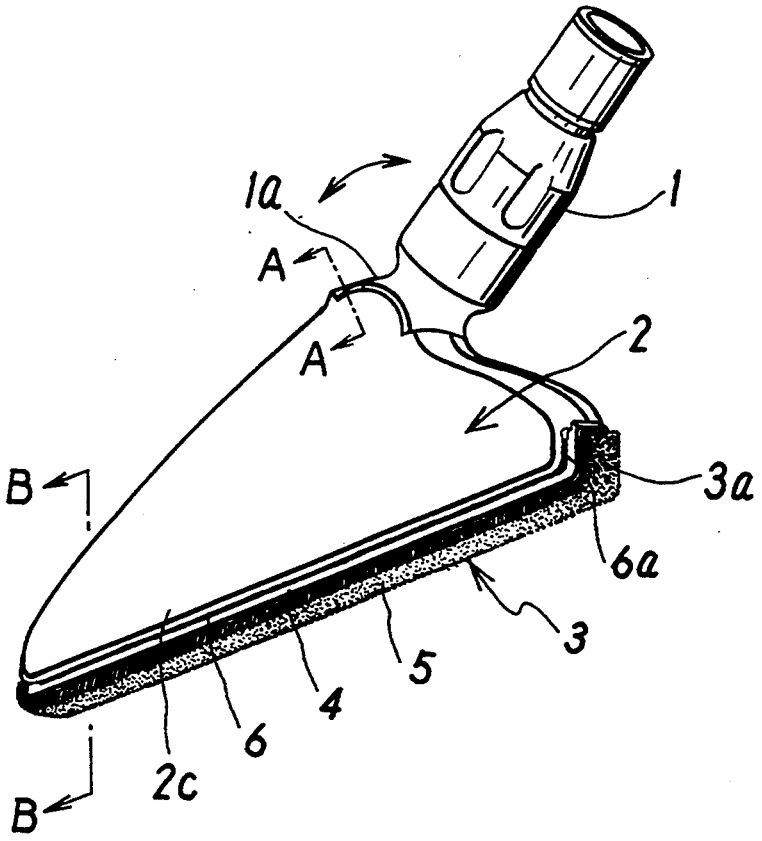
FIG. 1 is a perspective view of an embodiment of the present invention.
Figure 2:
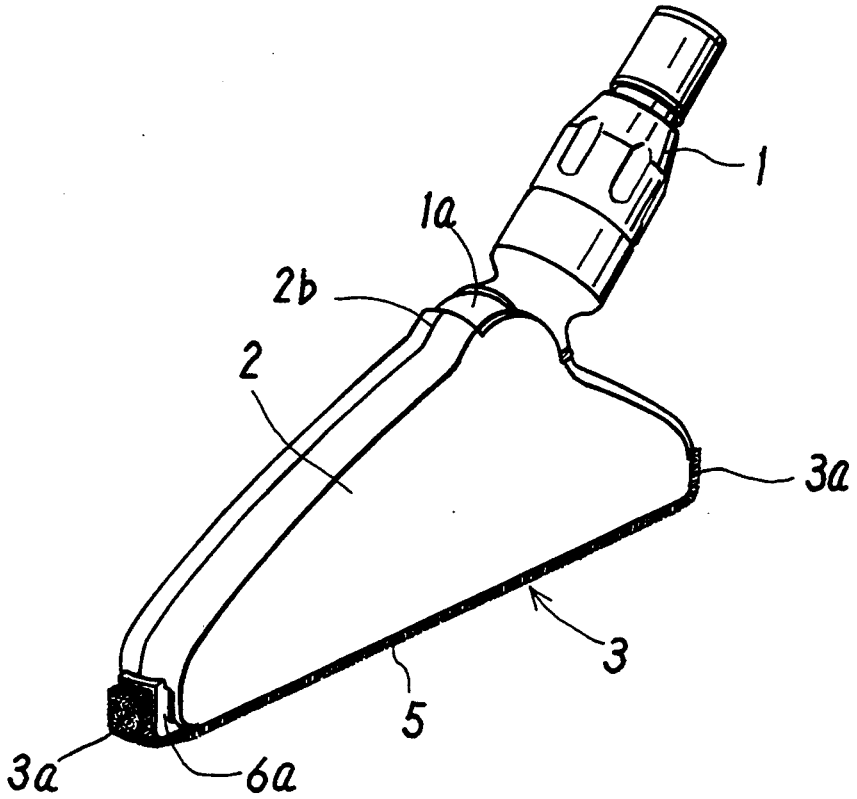
FIG. 2 is a perspective view of the same embodiment taken from a different direction.
Figure 3:
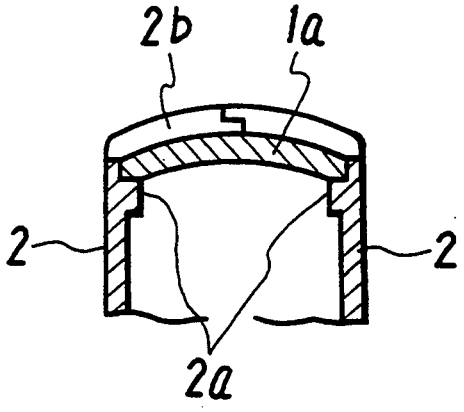
FIG. 3 is a sectional view taken on line A—A of FIG. 1.

As mentioned before, the joint pipe 1 is pivotally connected to the brush holder box 2, permitting the operator to vary the angle of the joint pipe 1 relative to the brush holder box 2 within a range of about 90°, that is, to vary the angular position of the joint pipe 1 from a vertical upright position to a horizontal flat position relative to the brush holder box 2 with the brush 3 on its bottom side in a horizontal state. More specifically, as shown in FIGS. 1 to 3, in order to permit the adjustments of the joint pipe angle, an arcuate guide portion 1*a* at the fore end of the joint pipe 1 is slidably fitted between a top wall portion 2*b* of the brush holder box 2 and ribs 2*a* which are provided on interior surfaces of the brush holder box 2. For the purpose of holding the joint pipe 1 in an arbitrary angular position relative to the brush holder box 1, it is preferable to provide frictional or other suitable retaining means between their joined parts for tentatively holding the joint pipe in a desired angular position.

The guide portion 1*a* of the joint pipe 1 also has a function of closing the opening in the top wall 2*b* of the brush retaining box 1.

Figure 4:
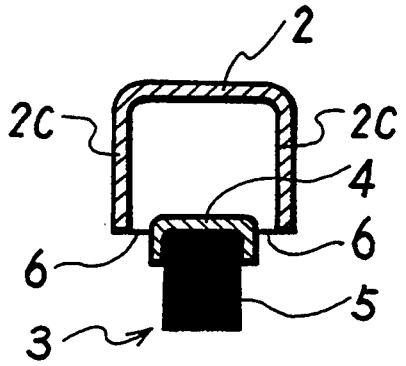
FIG. 4 is a sectional taken on line B—B of FIG. 1.

The brush 3 to be mounted in the intake opening at the bottom of the brush holder box 2 has brush hair 5 planted on a base plate 4, and, as shown particularly in FIG. 4, is mounted centrally of the intake opening which is opened on the bottom side of the brush holder box 2, bisecting the intake opening into a couple of segmental intake openings 6. Further, the brush 3 is bent upward at the opposite ends of the brush holder box 2 as indicated at 3*a*. These upturned end portions 3*a* of the brush 3 are located centrally of the extended end portions of the intake opening, which is extended slightly upward at the front and rear ends of the brush holder box 2, thereby forming additional intake openings 6*a* between the brush 3 and each of the opposite side walls 2*c* of the brush holder box 2. The provision of the upturned portions 3*a* of the brush 3 and the additional intake openings 6*a* at the opposite ends of the brush holder box 2 makes it easier to clean a narrow space or a corner portion by using the suction nozzle attachment n the fashion of a broom.

The vacuum cleaner suction nozzle attachment, with the above-described construction according to the present invention, takes a broom-like shape as a whole when its joint pipe 1 is connected t, the suction pipe of a vacuum cleaner prior to cleaning a floor surface or the like. Therefore, the suction pipe of the vacuum cleaner can be handled like a broomstick, or example, permitting the operator to sweep and clean a floor surface with the suction nozzle attachment easily by moving same to the left and right in the same manner as with a broom. The suction nozzle attachment can be suitably used especially when sweeping out and cleaning up dust in narrow spaces and corner portions of wooden or Tatami floors in relatively small Japanese style houses.

As the above-described suction nozzle attachment can be handled and put in a sweeping movement like a broom, dust on a floor surface is floated up and sucked in through the segmental intake openings on the opposite sides of the brush 3 which is located centrally of the intake opening at the bottom of the brush holder box 2. Therefore, as compared with he conventional vacuum cleaner attachments which tend to stick to the floor surface under the influence of the suction force during a floor sweeping operation, the suction nozzle attachment of the present invention can be handled more easily and moved lightly along a floor surface to be cleaned up. Besides, on such occasions, the dust which is being floated up by the sweeping action of the rush 3 is effectively caught into the segmental intake openings which are located on the opposite sides of the bush 3.

Further, as mentioned before, the fore end of the joint pipe 1 is pivotally or swingably connected to the flattened brush holder box 2, it becomes possible to vary arbitrarily the angular position of the joint pipe 1 relative to the brush holder box 2 between the flattened side surfaces of the latter to facilitate the sweeping operation all the more. Similarly, dust in corner portions which meet wall surfaces can be easily swept and cleaned up by the upturned brush portions 3*a* at the opposite ends of the brush holder box 2.

Figure 5:
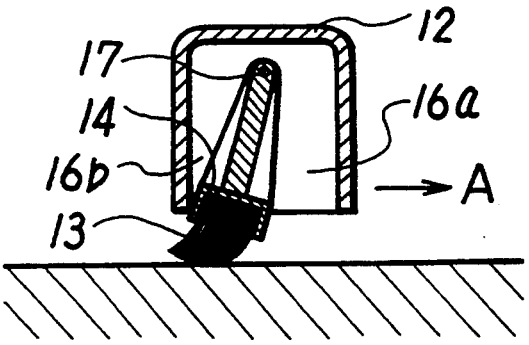
FIG. 5 is a sectional view similar to FIG. 4 but showing a suction nozzle attachment in another embodiment of the invention, the nozzle attachment being moved in one direction.
Figure 6:
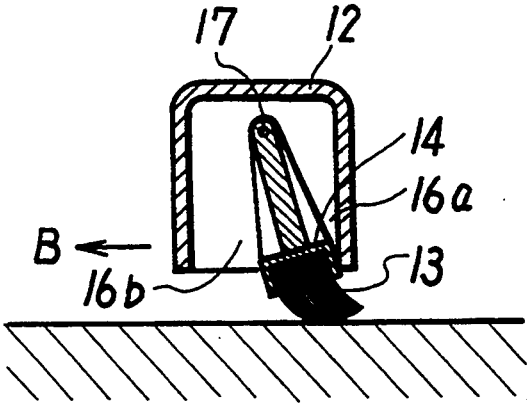
FIG. 6 is a view similar to FIG. 5, showing the nozzle attachment being moved in the opposite direction.
Figure 7:
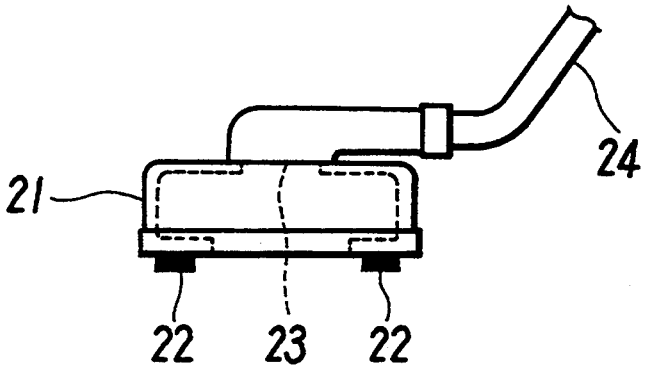
FIG. 7 is a side view of a conventional counterpart.
Figure 8:
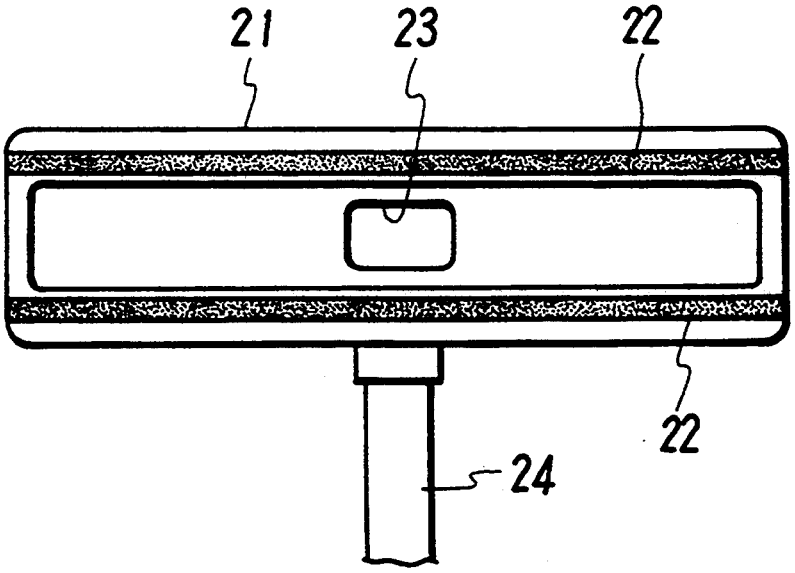
FIG. 8 is a bottom view of the conventional nozzle attachment of FIG. 7.

Referring now to FIGS. 5 and 6, there is illustrated another embodiment of the intention, employing a rocking brush 13 which has its base plate 14 rockably mounted in the brush holder box 12 through a pin 17 in such a manner that, when the suction nozzle attachment is moved in one sideward direction, the brush 13 is rocked in the opposite sideward direction, widely opening one of the segmental intake openings, which is in a forward position in terms of the direction of movement of the suction nozzle attachment, while closing the other intake opening in the rear position. Namely, as shown in FIG. 5, when the suction nozzle attachment is moved in the direction of arrow A, the base plate 14 of the brush 13 is rocked to close the intake opening 16*b* in a posterior position in the direction of movement of the suction nozzle attachment, widely opening the other intake opening 16*a* in a forward position to suck in the dust which is being swept up by the brush 13. As shown particularly in FIG. 6, when the suction nozzle attachment is moved in the direction of arrow B, the base plate 14 of the brush is tilted in the opposite direction as shown in the drawing, this time closing the intake opening 16*a* in a posterior position in the direction of movement of the suction nozzle attachment and widely opening the other intake opening 16*b* to suck thereinto the dust which is being swept up by the brush 13.

As understood from the foregoing detailed description, the vacuum cleaner suction nozzle attachment according to the present invention can be used in the fashion of a broom, and is particularly suitable for sweeping and vacuuming dust in narrow spaces or corner portions of a floor.

What is claimed is:

1. A suction nozzle attachment for a vacuum cleaner, comprising: a joint pipe and a brush holder box having an intake opening on a bottom side thereof, said joint pipe having one end connectable to a suction pipe of said vacuum cleaner and the other end of said joint pipe connected to an apex portion of said brush holder box at a top of said brush holder box and with said joint pipe extending upwardly therefrom, and said brush holder box having a brush mounted in said intake opening on a bottom side thereof such that a broom-like shape as a whole is provided when said suction nozzle attachment is connected to said suction pipe of said vacuum cleaner, said brush holder box including substantially flat front and rear surfaces with said broom-like shape defined by said brush holder box having said apex portion with said joint pipe and suction pipe extending upwardly both from said apex portion and between said front and rear surfaces.

2. A suction nozzle attachment for a vacuum cleaner as defined in claim 1, wherein said joint pipe is pivotally connected to said brush holder box to permit adjustments of the angle of said joint pipe relative to said brush holder box.

3. A suction nozzle attachment for a vacuum cleaner as defined in claim 1, wherein said brush is located centrally of said intake opening on the bottom side of said brush holder box in such a manner as to bisect said intake opening into a couple ff segmental intake openings.

4. A suction nozzle attachment for a vacuum cleaner, comprising:

a joint pipe and a brush holder box having an intake opening on a bottom side thereof, said joint pipe having one end connectable to a suction pipe of said vacuum cleaner and the other end of said joint pipe connected to a top portion of said brush holder box, said brush holder box having a brush mounted in said intake opening on a bottom side thereof;

wherein said brush is located centrally of said intake opening on the bottom side of said brush holder box in such a manner as to bisect said intake opening into a couple of segmental intake openings; and wherein said intake opening on the bottom side of said brush holder box is slightly extended upward at the opposite ends of said brush holder box, and the opposite end portions of said brush are turned upward into the extended end portions of said intake opening, thereby providing additional intake openings at the opposite ends of said brush holder box.

5. A suction nozzle attachment for a vacuum cleaner as defined in claim 3, wherein said brush is rockably mounted in said intake opening at the bottom of said brush holder box and adapted to be tilted toward side walls of the brush holder box as said suction nozzle attachment is moved in sideward directions, alternately closing and opening the segmental intake openings on the opposite sides of said brush.

6. The suction nozzle attachment of claim 1, wherein said brush holder box has a substantially flat shape defined by substantially flat front and rear surfaces of said brush holder box, and wherein said joint pipe is pivotally connected to said brush holder box such that said joint pipe is pivotally movable in a plane which is parallel to said substantially flat front and rear surfaces.

7. A suction nozzle attachment for a vacuum cleaner comprising:

a joint pipe and a brush holder box having an intake opening on a bottom side thereof, said joint pipe having one end connectable to a suction pipe of said vacuum cleaner and the other end of said joint pipe connected to a top portion of said brush holder box and with said joint pipe extending upwardly from said top portion of said brush holder box, and wherein said brush holder box includes a brush mounted in said intake opening on a bottom side thereof, and further wherein a broom-like shape as a whole is provided when said suction nozzle attachment is connected to said suction pipe of said vacuum cleaner, and wherein said brush holder box includes substantially flat front and rear surfaces, and further wherein said joint pipe extends upwardly from said brush holder box within a plane substantially parallel to said front and rear surfaces, whereby said broom-like shape is defined by said brush holder box having said joint pipe extending upwardly from the top portion of said brush holder box and in said plane.

8. The suction nozzle attachment of claim 7, wherein during a sweeping movement said suction nozzle attachment is moved in a direction perpendicular to said substantially flat front and rear surfaces and an intake opening is disposed at a leading side of said brush holder box with respect to said direction of movement of the suction nozzle attachment regardless of whether said front side is leading or said rear side is leading.

9. The suction nozzle attachment of claim 8, wherein said brush is provided in the form of a long rectilinear brush provided at a bottom of said brush holder box.

10. The suction nozzle attachment of claim 8, wherein said joint pipe is pivotally connected to said brush holder box such that said joint pipe is pivotable in said plane which is parallel to said front and rear surfaces of said brush holder box.

11. The suction nozzle attachment of claim 7, wherein said joint pipe is pivotally connected to said brush holder box such that said joint pipe is pivotable in said plane which is parallel to said front and rear surfaces of said brush holder box.

12. The suction nozzle attachment of claim 7, wherein said top portion of said brush holder box includes inclined surfaces which meet at an apex, and wherein said joint pipe extends from said apex.

* * * * *